United States Patent [19]

von der Eltz et al.

[11] 4,420,309

[45] Dec. 13, 1983

[54] PROCESS FOR THE CONTINUOUS OR SEMICONTINUOUS DYEING OF TUBULAR KNITTED FABRICS OF CELLULOSE FIBERS WITH AZO DEVELOPING DYESTUFFS AND ACRYLAMIDE POLYMER

[75] Inventors: Hans-Ulrich von der Eltz, Frankfurt am Main; Peter Heinisch, Kelkheim; Hans J. Ballmann, Frankfurt am Main, all of Fed. Rep. of Germany

[73] Assignee: Hoechst Aktiengesellschaft, Frankfurt am Main, Fed. Rep. of Germany

[21] Appl. No.: 401,015

[22] Filed: Jul. 22, 1982

Related U.S. Application Data

[63] Continuation of Ser. No. 288,014, Jul. 29, 1981, abandoned.

[30] Foreign Application Priority Data

Jul. 30, 1980 [DE] Fed. Rep. of Germany ..... 3028844

[51] Int. Cl.[3] ..... D06P 1/12; D06P 3/68

[52] U.S. Cl. ..... 8/555; 8/666; 8/918

[58] Field of Search ..... 8/555, 666

[56] References Cited

U.S. PATENT DOCUMENTS

| | | | |
|---|---|---|---|
| 3,957,427 | 5/1976 | Chambers | 8/555 |
| 4,224,027 | 9/1980 | Hertel et al. | 8/666 |
| 4,304,567 | 12/1981 | Ballmann et al. | 8/555 |
| 4,323,363 | 4/1982 | Brachten et al. | 8/532 |

FOREIGN PATENT DOCUMENTS

| | | |
|---|---|---|
| 2808909 | 8/1979 | Fed. Rep. of Germany . |
| 55-51884 | 4/1980 | Japan . |
| 1523408 | 8/1978 | United Kingdom . |

*Primary Examiner*—A. Lionel Clingman

*Attorney, Agent, or Firm*—Curtis, Morris & Safford

[57] ABSTRACT

Continuous dyeing of cellulose knitted fabrics in hose form, according to a two-bath procedure and without intermediate drying, with azo dyes produced on the fiber by coupling of their formation components could be realized hitherto on an industrial scale in exceptional cases only. For the most part this dyeing method failed generally due to the insufficient liquor uptake of the flattened textile material that had previously been impregnated, on subsequent slop-padding wet-in-wet with the developing liquor.

By incorporation of a combination comprising homo- or copolymers of acrylic acid amide and a wetting agent into the impregnation bath and the developing liquor, the liquor uptake thereof by the moist fiber material, both in the course of the impregnation phase and once more in the slop-padding operation for developing the dyes too, is increased and the penetration rate of the liquor during the coupling is improved in such a manner that textile hoses which exhibit even, well penetrated dyeings are obtained.

Dyeing of tubular knitted fabrics, especially in hose form, with azo developing dyes has become feasible only in accordance with this invention. The process may be carried out as well in semicontinuous operation.

11 Claims, No Drawings

PROCESS FOR THE CONTINUOUS OR SEMICONTINUOUS DYEING OF TUBULAR KNITTED FABRICS OF CELLULOSE FIBERS WITH AZO DEVELOPING DYESTUFFS AND ACRYLAMIDE POLYMER

This is a continuation of application Ser. No. 288,014 filed July 29, 1981, now abandoned.

The present invention relates to the even dyeing of a tubular knitted fabric in hose form and consisting of or containing preponderantly cellulose fibers, especially cotton, with at least one water-insoluble azo dyestuff produced on the fiber according to a continuous or semicontinuous method, in which the impregnation is performed by pre-padding the hose fabric with a coupling component under alkaline conditions, and subsequently the development of the dyestuff is effected, wet-in-wet, by slop-padding the textile goods with a diazo component in the presence of an acid and/or acid-forming substance.

The dyeing of cotton fabrics with azo developing dyes on a padder has been practiced for a long time. Generally, the textile material is intermediately dried after impregnating with the coupling component, and the dyestuff is then produced on the fiber by slop-padding the goods, that had initially been pre-padded, with the diazo component capable of being coupled. Nevertheless, this known process cannot be applied in the case of voluminous textiles, because migration problems arising on intermediate drying after the wet impregnation of the first step cannot be solved. Although it would in principle be possible to omit any intermediate drying and to slop-pad the goods wet-in-wet with the diazo component, but this is rarely feasible. Attempts to operate in this matter industrially have hitherto failed because of the impossibility of dissolving the required amounts of diazonium compound in the quantity of liquor additionally absorbed in the second padding operation by the goods already wet (from the impregnation); that is, under the prevailing conditions the liquor uptake on slop-padding with the developing bath is insufficient.

It is also possible to produce azo dyes in the fiber by applying a stabilized diazo component, which does not couple to the textile in the padding step for impregnation simultaneously with the coupling component. By subsequent slop-padding wet-in-wet with acid, releasing of the diazonium compound is caused and dyestuff coupling is effected. However, can be carried out in the case of non-voluminous, smooth fabric webs only, because in that of voluminous textiles in the interior of the said goods neutralization of the alkaline impregnation more rapidly proceeds than formation of the diazonium compound capable of being coupled, thus ultimately resulting in the aspect of poor color penetration due to non-uniform dyestuff coupling on the outside and in the interior of the textile material.

In the dyeing of tubular knitted fabrics in the form of a hose the above difficulties arise in an especially pronounced manner. Also in this case only an insufficient liquor pick-up may be effected onto the goods in the second padding step; that is, the solubility of the respective diazonium compound does not suffice for dissolving the required amount thereof in the quantity of liquor which can be absorbed, in addition, by the goods and which is solely available for the intended purpose.

Moreover, in this operation mode the concentration of alkali-binding agent for adjusting the pH range favorably for the coupling attains such a level that directly from the first, on contact of the impregnated, alkaline goods with the developing liquor locally an "overneutralization" occurs, by which phenomenon the dyestuff coupling that is proceeding slowly already due to the compactness of the goods, is still more adversely affected.

It was therefore the object of the present invention to overcome the cited disadvantages on two-bath dyeing of tubular knitted fabrics in hose form wet-in-wet with the components for producing water-insoluble azo dyestuffs on the fiber. In this connection above all the problem of how to bring about an increased liquor uptake by the textiles in the second padding with the diazo component or acid alone had to be solved.

In accordance with the invention, these objects are achieved by incorporating into the alkaline impregnation bath containing the coupling component a combination of a polymeric component selected from the group consisting of homopolymers and copolymers of acrylic acid amide and mixtures of the foregoing, said polymeric component being incorporated in an amount of from 10 to 30 g/l in the form of a 2 to 8, preferably 4 to 5% (by weight) aqueous formulation, and of from 2 to 20 g/l of an anionic wetting agent; and likewise incorporating into the acidic developing liquor containing the diazo component capable of being coupled a combination of a polymeric component selected from the group consisting of homopolymers and copolymers of acrylic acid amide and mixtures of the foregoing, said polymeric component being incorporated in an amount of from 30 to 60 g/l in the form of a 2 to 8, preferably 4 to 5% (by weight) aqueous formulation, and of from 2 to 20 g/l of an anionic or nonionic wetting agent.

Suitable homopolymers or copolymers of acrylic acid amide are, for example:

a. linear or branched homopolymers of acrylic acid amide;
b. copolymers of acrylic acid amide and semiesters of maleic acid with polyglycol ethers of natural or synthetic fatty alcohols of from 12 to 18 carbon atoms with 5 to 10 mols of ethylene oxide per mol of fatty alcohol, in the weight ratio of from 1:0.05 to 1:0.5, calculated on the acrylic acid amide;
c. copolymers of acrylic acid amide and acrylamido-lower alkane sulfonic acid in the weight ratio of from 1:0.05 to 1:0.5, calculated on the acrylic acid amide,
d. copolymers of acrylic acid amide and N-vinyl-N-methylacetamide in the weight ratio of from 1:0.05 to 1:0.5, calculated on the acrylic acid amide;
e. mixtures of the polymers specified under (a) to (d) above among one another and optionally in combination with ε-caprolactam in the weight ratio of from 1:0.5 to 1:1, calculated on the polymers.

The homopolymers of acrylic acid amide or the copolymers thereof with the other monomers cited sub (a) through (e) have a molecular weight of from $1.0\times10^6$ to $2.5\times10^6$, preferably $1.5\times10^6$ to $2.0\times10^6$.

Surprisingly, the specific properties of the above acrylic acid amide polymers bring about an increased liquor pick-up at the same roll pressure (in bar/cm$^2$). This effect is about proportional to the applied amount of the polymer products, i.e. the higher the concentration applied, the greater the increase of liquor pick-up within a technically justifiable range.

The assistance of homopolymers and copolymers of acrylic acid amide and a wetting agent according to the invention improves the dyestuff formation in that the liquor uptake by the goods both in the course of the impregnation and during the slop-padding operation, wet-in-wet, with the developing bath is increased and that the penetration through the double-lapped textile material is promoted in such a manner that even and completely dyed-through textiles are obtained.

It could not be expected that, contrary to the dyeing results occurred when omitting the combination of auxiliaries according to the invention, by means of the novel mode of processing a liquor uptake of 70 to 120% (of the weight of the dry goods), depending on setting of the rolls and efficiency of the padder used, is achieved on the textile hoses while padding with the impregnation liquor, and (this is possible only in the process of the invention) once more an additional liquor uptake of 90 to 130 weight % on slop-padding with the developing liquor; that is, as the final result a total liquor uptake rate of 180 to 250 weight % when padding twice. Only this quantity of liquor which is additionally available now permits the diazo component to be dissolved in the necessary amount. Moreover, the concentration of alkali-binding agent is thus kept at a normal level, so that the coupling conditions are no longer impaired. The addition of wetting agent on the other hand brings about a uniform permeation of both padding liquors in the textile hose, and contributes to a well penetrated and especially even dyeing.

Moreover, from the increased liquor uptake it results that irregularities present on the textile material immediately after having left the padder are balanced by diffusion, so that marks originating from squeezed edges of the fabric hose do not appear. Thus, a further drawback occuring in the attempts made as described above is removed, likewise.

By the use of the padding auxiliaries according to the process of the invention it is possible for the first time to dye also voluminous material in the form of a hose corresponding to a two-bath operation with the components for producing water-insoluble azo dyestuffs on the fiber perfectly and without intermediate drying. This constitutes great technical progress, because developing dyestuffs could hitherto not be applied in a wet-in-wet process but onto smooth and light fabrics only. Let alone that the novel process offers no advantages for the latter kind of goods, it is remarkable to observe that in these cases likewise the increase of liquor uptake which can be effected in accordance with the invention by addition of the acrylic acid amide polymers and the wetting agent is not obtained at all.

Of the textile materials, there are suitable for the process of the invention tubular knitted fabrics which consist of or contain preponderantly cellulose fibers, especially cotton, that are treated in hose form and for which the uniformity of dyeing is particularly important. In the case of knitted fabrics, even unbleached loom-state goods (especially advantageous with very full or covered shades) may be used.

Of course, the process of the invention can be applied also in the case of goods in cut-opened form.

For the dyeing of textiles according to the invention those chemical compounds conventional for producing developing dyestuffs and listed in Colour Index, 3rd ed., 1971 as "Azoic Coupling Component" and "Azoic Diazo Component" are considered useful.

Of the polymeric products derived from acrylic acid amide applied in accordance with the invention, some are already known (German Offenlegungsschrift No. 2,542,051, CASSELLA AKTIENGESELLSCHAFT), however, they are used for a completely different purpose, namely to suppress the "frosting effect" in the dyeing of polyester fibers with disperse dyestuffs.

The novel process is carried out as follows: First, the textile hose is flatted for padding. The first padding for impregnation purposes is carried out as customary on a padder, using an alkaline solution of a coupling component and adding the combination according to the invention comprising polymerized acrylic acid amide and wetting agent, in the quantitative ratio as required. Thus, a liquor uptake value of generally from 70 to 120 weight % is obtained. After an air passage (continuously) or an intermediate short-time dwelling of the goods (semicontinuously), the impregnation so obtained is slop-padded, wet-in-wet, in the presence of an alkali-binding agent (acid or acid-forming substances) with the developing liquor containing a diazo component capable of being coupled; the combination comprising acrylic acid amide polymer and wetting agent being added to this padding liquor in the amounts as indicated.

A modification of the process of the invention offers the following operation mode: The textile goods are prepadded for impregnation purposes in the first padding step with an alkaline liquor containing the coupling component together with a diazo component which is not (yet) capable of being coupled (either in the form of a diazonium compound of a diazotizable amine, which is stabilized, i.e. not capable of being coupled under the above conditions; or in the form of a diazotizable amine with the sodium nitrite required for diazotization, the amine being in a correspondingly prepared state, that is, finely dispersed or dissolved in organic solvents), and the combination according to the invention. In the subsequent second padding step, the acid (releasing the coupling; or the diazotization and the coupling) together with the combination comprising polyacrylic acid amide/wetting agent is applied onto the goods. This modified embodiment may be further varied by applying onto the fiber material coupling component and sodium nitrite together with the combination in the first padding step, and then in the second step, slop-padding a diazotizable amine, acid and the combination onto the impregnation in order to develop the dyestuff.

The following Examples illustrate the invention without limiting its scope in any way, especially with respect to the wetting agents used. Percentages referred to in the Examples are by weight; in the case of wet treatment of textiles these percentages of liquor uptake are relative to the weight of the dry goods.

EXAMPLE 1

300 kg of a grey, unbleached interlock tubular knitted fabric made of cotton are to be dyed semicontinuously. The goods are padded for this purpose on a padder with a padding liquor having a temperature of 20° C. and containing an aqueous solution of

- 15 g/l of Azoic Coupling Component 2, C.I. No. 37505 (dissolved according to the directions for dissolution in cold state),
- 7.5 g/l of a 32.5% sodium hydroxide solution,
- 5 $cm^3$/l of a protective colloid on the basis of a fatty acid/protein condensation product, 40 $cm^3/l$ of ethanol denat.,
15 $cm^3/l$ of 33% formaldehyde,
15 g/l of a 4.3% aqueous formulation of a linear homopolymer of acrylic acid amide (molecular weight $1.4\times10^6$) and
5 $cm^3/l$ of a wetting agent comprising 80% of sodium alkylsulfonate and 20% of the addition product of 8 mols of ethylene oxide onto 1 mol of isotridecanol.

In this manner, a liquor uptake of 100% is achieved applying the first padding step. The treated goods are then wound up and allowed to dwell for 1 hour with slow rotation of the batching rollers. For developing the dyestuff, the impregnated goods are slop-padded on a padder wet-in-wet at 20° C., with the use of an aqueous solution containing 54 g/l of stabilized diazonium compound of Azoic Diazo Component 5, C.I. No. 37125,
6 $cm^3/l$ of a 60% strength acetic acid,
2 $cm^3/l$ of dispersing agent on the basis of an o-cresol-camphor resin which is oxethylated per mol with 19.5 mols of ethylene oxide,
45 g/l of the above formulation of acrylic acid amide homopolymer, and
5 $cm^3/l$ of the above wetting agent.

Thus, a further liquor uptake of 100% is the result on the knitted hose, that is, the total liquor uptake amounts to 200%. Dyestuff formation is completed subsequently by an air passage of the fiber material for 30 seconds and a passage through hot water at 80° C. Thereafter, the dyeing so produced is soaped and dried as usual.

An even and fully penetrated dyeing in a bordeaux red shade is obtained on the textile hose.

When dyeing is carried out analogously as described above, but without adding the combination comprising acrylic acid amide polymer and wetting agent, the liquor uptake results to 90% in the first padding and is 20% only in the second padding operation so that the textile hose so treated is dyed uneven and penetrated by the dye partially not at all, that is, there are yielding some white places still on the fiber material. An increase of the concentration of diazonium compound to 270 g/l, which would be required at an additional liquor uptake of 20% only (as occured in this case) fails because of the insufficient solubility of the diazo component.

EXAMPLE 2

150 kg of a grey, unbleached interlock tubular fabric made of cotton are to be dyed.

The textile material is padded on a padder with the use of an aqueous padding liquor having a temperature of 20° C. and containing
14 g/l of Azoic Coupling Component 8, C.I. No. 37525 (dissolved according to the directions for dissolution in cold state),
14 $cm^3/l$ of a 32.5% sodium hydroxide solution,
5 g/l of a protective colloid on the basis of lignosulfonic acid,
35 g/l of the diazonium compound of Azoic Diazo Component 46, C.I. No. 37080 stabilized in the form of an aminoazo compound which is not capable of being coupled,
2 g/l of oleylmethyltaurine,
7.5 $cm^3/l$ of ethanol denat.,
5 g/l of a wetting agent on the basis of di-isobutylnaphthalene-sulfonic acid (sodium salt),
20 g/l of a 4% aqueous formulation of a copolymer of acrylic acid amide and 2-acrylamido-2-methyl-propane-1-sulfonic acid in a weight ratio of 1:0.1, relative to acrylic acid amide (molecular weight of the copolymer: $1.9\times10^6$).

In this manner, a liquor uptake by the textile goods of 120% is achieved. After an air passage for 3 minutes, the impregnated goods are slop-padded, wet-in-wet, on a padder using an aqueous liquor having a temperature of 80° C. and containing
75 $cm^3/l$ of a 60% strength acetic acid,
50 g/l of sodium chloride,
10 g/l of sodium acetate, cryst.,
2 g/l of the dispersing agent of Example 1,
5 $cm^3/l$ of a wetting agent on the basis of an alkylsulfonate, and
45 g/l of the above copolymer formulation.

An additional liquor uptake of 120% on the knitted hose results from the second padding operation. An air passage of the so treated fiber material for 45 seconds and a passage through hot water of 80° C. complete the dyestuff coupling thereupon.

Following an after-treatment as usual, an even and fully penetrated dyeing in a brilliant scarlet shade is obtained on the textile hose.

EXAMPLE 3

Cotton interlock goods are to be bleached and dyed simultaneously. For this purpose, the knitted hose is padded on a padder to yield a liquor uptake of 100%, with the use of an aqueous padding liquor having a temperature of 20° C. and containing
16 g/l of Azoic Coupling Component 20, C.I. No. 37530 (dissolved according to the directions for dissulution in cold state),
8 $cm^3/l$ of a 32.5% sodium hydroxide solution,
5 g/l of a protective colloid on the basis of sodium ligninsulfonate
43 g/l of the diazonium compound of Azoic Diazo Component 32, C.I. No. 37090, stabilized in the form of an aminoazo compound, which is not capable of being coupled,
2 g/l of oleylmethyltaurine,
50 $cm^3/l$ of ethanol denat.,
30 g/l of a 50% aqueous solution of sodium chlorite ($NaClO_2$),
5 g/l of the wetting agent of Example 1, and
15 g/l of a 4.3% aqueous formulation of a copolymer of acrylic acid amide and the maleic acid semiester of a polyglycol ether from the addition product of 8 mols of ethylene oxide onto 1 mol of isotridecanol, in a weight ratio of 1:0.075, relative to acrylic acid amide (molecular weight of the copolymer: $1.47\times10^6$).

After the first padding operation, the impregnated goods are wound up in order to dwell for 1 hour, and then slop-padded, without intermediate drying, on a padder using an aqueous liquor having a temperature of 80° C. and containing the following additives:
64 $cm^3/l$ of acetic acid,
50 g/l of sodium chloride,
10 g/l of sodium acetate, cryst.,
2 $cm^3/l$ of a dispersing agent comprising 80% of stearyl alcohol polyglycol ether which is oxethylated per mol with 25 mols of ethylene oxide, and 20% of a polyethyleneglycol having a molecular weight of 6000,
5 g/l of the above wetting agent, and
45 g/l of the above copolymer formulation.

The goods are then wound up again and allowed to dwell for 3 hours at 85° C. for completion of the dyestuff coupling. The additional liquor uptake in the second padding step amounts 100%, so that the textile hose now contains 200% of moisture. After the above residence time, the dyeing is rinsed and after-treated as usual. A husk-free tubular fabric with a brilliant red dyeing is obtained; dyestuff penetration and evenness are perfect.

The second step of treatment may be carried out also continuously, with the same result, by steaming the goods for 3 minutes at 103° C. for completing the dyestuff development, instead of treating them at 85° C. for 3 hours.

EXAMPLE 4

250 kg of grey, unbleached cotton interlock goods in hose form are to be dyed. The goods are paddes on a padder using a liquor containing an aqueous solution of 16 g/l of Azoic Coupling Component 12, C.I. No. 37550 (dissolved according to the directions for dissolution in cold state), 8 $cm^3/l$ of a 32.5% sodium hydroxide solution,
5 $cm^3/l$ of the protective colloid of Example 1,
50 $cm^3/l$ of ethanol denat.,
16 g/l of a dispersion of Azoic Diazo Component 42, C.I. No. 37150,
15 g/l of sodium nitrite,
5 $cm^3/l$ of the wetting agent of Example 1,
15 g/l of a 4.3% aqueous formulation of a branched homopolymer of acrylic acid amide (molecular weight $1.4\times10^6$), in cold state (20° C.); the liquor uptake in this first step amounts to 120%. Then the impregnated goods are wound up in order to dwell for 1 hour.

Now, dyestuff formation is started by slop-padding the wet textile hose on a padder at 20° C. with an aqueous liquor containing 50 g/l of monochloroacetic acid,
5 g/l of the above wetting agent, and
50 g/l of the above acrylic acid amide homopolymer formulation, thus effecting an additional liquor uptake of 100% (total liquor uptake 220%), and completed by an air passage of the textile article so treated for 20 seconds, and a passage through hot water at 80° C.

Subsequently to an after-treatment of the goods carried out as usual, a perfectly penetrated dyeing in an even, brilliant red shade is obtained on the textile hose.

EXAMPLE 5

For dyeing 60 kg of grey cotton interlock goods in hose form, the goods are padded on a padder at 20° C. to yield a liquor uptake of 90%, with a padding liquor containing an aqueous solution of 20 g/l of Azoic Coupling Component, C.I. No. 37530 (dissolved according to the directions for dissolution in cold state),
10 $cm^3/l$ of a 32.5% sodium hydroxide solution,
5 $cm^3/l$ of a protective colloid as in Example 1,
50 $cm^3/l$ of ethanol denat.,
15 g/l of sodium nitrite,
5 $cm^3/l$ of a wetting agent on the basis of di-isobutyl-naphthalene-sulfonate,
15 g/l of a 4.5% aqueous formulation of a copolymer of acrylic acid amide and the maleic acid semiester of a polyglycol ether from the addition product of 7 mols of ethylene oxide onto 1 mol of stearyl alcohol, in a weight ratio of 1:0.08, relative to the acrylic acid amide (molecular weight of the copolymer: $1.4\times10^6$), the impregnated goods are wound up and allowed to dwell for 1 hour at room temperature. Thereafter, they are slop-padded, wet-in-wet, on a padder at 20° C. to yield a liquor uptake of additional 110%, with the use of an aqueous developing liquor containing per liter of water 25 g/l of a 45% liquid formulation of Azoic Diazo Component 5, C.I. No. 37125,
50 g/l of monochloroacetic acid,
5 g/l of the above wetting agent, and
50 g/l of the above copolymer formulation.

The dyestuff development is completed by an air passage of the knitted fabric for 60 seconds, and a passage through hot water at 80° C. Following the usual after-treatment of the dyeing, the interlock hose presents an even and well penetrated dyeing in a dull red shade.

EXAMPLE 6

Continuous dyeing of grey cotton interlock goods in hose form: The padding liquor for impregnation contains in this case the following aqueous solution: 12 g/l of Azoic Coupling Component 20, C.I. No. 37530 (dissolved according to the directions for dissolution in cold state), 6 $cm^3/l$ of a 32.5% sodium hydroxide solution,
5 $cm^3/l$ of a protective colloid as in Example 1,
50 $cm^3/l$ of ethanol denat.,
5 $cm^3/l$ of the wetting agent of Example 1, and
15 g/l of a 4% aqueous formulation of branched homopolymer of acrylic acid amide (molecular weight $1\times10^6$).

The textile hose is padded on a padder at 20° C. with this liquor resulting a liquor uptake of 120%, plaited down for 3 minutes in a rope slide, and then slop-padded, without intermediate drying and without interruption of the transporting motion, on a second padder using a developing liquor containing 19 g/l of the diazonium compound of a 45% formulation of Azoic Diazo Component 12, C.I. No. 37105,
12 g/l of sodium acetate,
9 $cm^3/l$ of a 60% strength acetic acid,
5 $cm^3/l$ of the above wetting agent, and
50 g/l of the above acrylic acid amide homopolymer formulation.

The liquor uptake of the hose in this second padding amounts to 90%. For completing the dyestuff coupling, the textile hose is subjected to an air passage of 40 seconds and a passage through hot water at 80° C.

The dyeing is then after-treated as usual for the dyeing with developing dyes. In this manner, a brilliant orange dyeing of the tubular fabric is obtained; evenness and penetration are good.

When operating in the same manner, but with omission of the combination comprising wetting agent and acrylic acid amide polymer both in the impregnation bath and in the developing liquor, a liquor uptake value of likewise 120% is attained in the impregnation step, at a corresponding setting of the padder rolls. However, it is then impossible to realize an additional liquor uptake in the second padding operation. Penetration of the developing liquor into the textile hose is nearly not attained at all in this case, and an uneven orange shade is the result, while yielding several places in the interior of the tubular fabric that are not dyed at all.

What is claimed is:

1. In a process for the even dyeing of a tubular knitted fabric in hose form, consisting of or containing preponderantly cellulose fibers, with at least one water-insoluble azo dyestuff produced on the fiber according to a continuous or semicontinuous method, in which the impregnation is performed by pre-padding the hose fabric with a coupling component under alkaline conditions, and subsequently the development of the dyestuff is effected, wet-in-wet, by slop padding the textile goods with a diazo component in the presence of an acid and/or an acid-forming substance, the improvement which comprises incorporation into the alkaline impregnation bath containing the coupling component a combination of a polymeric component selected from the group consisting of homopolymers and copolymers of acrylic acid amide and mixtures thereof, said polymeric component being incorporated in an amount of from 10 to 30 g/l in the form of a 2 to 8% (by weight) aqueous formulation, and of from 2 to 20 g/l of an anionic wetting agent; and likewise incorporating into the acidic developing liquor containing the diazo component capable of being coupled a combination of a polymeric component selected from the group consisting of homopolymers and copolymers of acrylic acid amide and mixtures thereof, said polymeric component being incorporated in an amount of from 30 to 60 g/l in the form of a 2 to 8% (by weight) aqueous formulation, and of from 2 to 20 g/l of an anionic or nonionic wetting agent.

2. A process as claimed in claim 1, wherein said polymeric component is selected from the group consisting of linear homopolymers and branched homopolymers of acrylic acid amide.

3. A process as claimed in claim 1, wherein said polymeric component is selected from the group consisting of copolymers of acrylic acid amide and semiesters of maleic acid with polyglycol ethers produced from natural or synthetic fatty alcohols of from 12 to 18 carbon atoms and from 5 to 10 mols of ethylene oxide per mol of fatty alcohol, in a weight ratio of from 1:0.05 to 1:0.5, calculated on the acrylic acid amide.

4. A process as claimed in claim 1, wherein the polymeric component is selected from the group consisting of copolymers of acrylic acid amide and acrylamido-lower alkane sulfonic acid in a weight ratio of from 1:0.05 to 1:0.5, calculated on the acrylic acid amide.

5. A process as claimed in claim 1, wherein said polymeric component is selected from the group consisting of copolymers of acrylic acid amide and N-vinyl-N-methyl-acetamide in a weight ratio of from 1:0.05 to 1:0.5, calculated on the acrylic acid amide.

6. A process as claimed in claim 1, wherein the polymeric component is a mixture of said homopolymers, a mixture of said copolymers or a mixture of one or more of said homopolymers and one or more of said copolymers.

7. A process as claimed in claim 1, wherein to said polymeric component ε-caprolactam is added in a weight ratio of from 1:0.5 to 1:1, calculated on the weight of the polymeric component.

8. A process as claimed in claim 1, wherein the polymeric component has a molecular weight of from $1.0\times10^6$ to $2.5\times10^6$.

9. A modification of the process as claimed in claim 1, wherein the alkaline impregnation bath contains, in addition to the combination of the polymeric compound and the wetting agent, combination, the coupling component and a diazonium compound not capable of being coupled of a diazotizable amine; and the acidic developing liquor contains, in addition to the auxiliaries' combination, substantially only acid.

10. A modification of the process as claimed in claim 1, wherein the alkaline impregnation bath contains, in addition to the combination of the polymeric compound and the wetting agent, combination the coupling component, a diazotizable amine and sodium nitrite; and the acidic developing liquor contains, in addition to the auxiliaries' combination, substantially only acid.

11. A modification of the process as claimed in claim 1, wherein the alkaline impregnation bath contains, in addition to the combination of the polymeric compound and the wetting agent, combination, the coupling component and sodium nitrite; and the acidic developing liquor contains, in addition to the auxiliaries' combination, a diazotizable amine and acid.

* * * * *